US010312013B2

(12) United States Patent
Kawasaki et al.

(10) Patent No.: US 10,312,013 B2
(45) Date of Patent: Jun. 4, 2019

(54) COIL COMPONENT

(71) Applicant: TDK Corporation, Tokyo (JP)

(72) Inventors: Yoshihiro Kawasaki, Tokyo (JP); Syun Ashizawa, Tokyo (JP); Hirohumi Asou, Tokyo (JP); Nobuo Takagi, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 15/426,445

(22) Filed: Feb. 7, 2017

(65) Prior Publication Data

US 2017/0229230 A1 Aug. 10, 2017

(30) Foreign Application Priority Data

Feb. 9, 2016 (JP) ..... 2016-022359

(51) Int. Cl.

| | |
|---|---|
| ***H01F 27/29*** | (2006.01) |
| ***H01F 27/255*** | (2006.01) |
| ***H01F 27/28*** | (2006.01) |
| ***H01F 3/10*** | (2006.01) |

(52) U.S. Cl.

CPC ..... *H01F 27/255* (2013.01); *H01F 3/10* (2013.01); *H01F 27/2823* (2013.01); *H01F 27/2828* (2013.01); *H01F 27/292* (2013.01)

(58) Field of Classification Search

USPC ..... 336/192, 83, 233

See application file for complete search history.

(56) References Cited

U.S. PATENT DOCUMENTS

| | | | | |
|---|---|---|---|---|
| 2003/0071704 | A1* | 4/2003 | Toi | H01F 17/045 336/83 |
| 2005/0115628 | A1* | 6/2005 | Sasaki | H01F 41/066 140/92.1 |
| 2008/0224813 | A1* | 9/2008 | Hirai | H01F 17/045 336/216 |
| 2010/0099365 | A1 | 4/2010 | Aramaki et al. | |
| 2014/0218147 | A1* | 8/2014 | Chatani | H01F 17/0013 336/20 |
| 2015/0084731 | A1* | 3/2015 | Takagi | H01F 19/08 336/212 |
| 2016/0268033 | A1* | 9/2016 | Kim | H02J 17/00 |
| 2016/0293309 | A1* | 10/2016 | Inagaki | H01F 3/08 |

FOREIGN PATENT DOCUMENTS

| | | | |
|---|---|---|---|
| JP | H09-219318 | A | 8/1997 |
| JP | 2003-209010 | A | 7/2003 |
| JP | 2004-363178 | A | 12/2004 |

* cited by examiner

*Primary Examiner* — Elvin G Enad
*Assistant Examiner* — Kazi S Hossain
(74) *Attorney, Agent, or Firm* — Young Law Firm, P.C.

(57) ABSTRACT

Disclosed herein is a coil component that includes a drum core having a winding core and first and second flange portions provided at opposite ends of the winding core; a wire wound around the winding core; terminal electrodes provided in the first and second flange portions, the terminal electrodes being connected to ends of the wire; and a magnetic top plate made of magnetic-powder containing resin in which soft magnetic metal powder having a flat shape is mixed in binder resin, the magnetic top plate being fixed to the first and second flange portions.

2 Claims, 5 Drawing Sheets

COIL COMPONENT

BACKGROUND OF THE INVENTION

Field of the Invention

The present invention relates to a coil component, and more particularly relates to a coil component using a drum core.

Description of Related Art

A coil component using a drum core can be surface-mounted on a printed circuit board differently from a coil component using a toroidal core, and thus has been widely used for mobile electronic devices such as a smartphone. Further, because the coil component using a drum core has a low height, it also contributes to thinning of mobile electronic devices.

However, in recent years, further thinning of mobile electronic devices has been desired, and in order to realize this, a further lower height has been desired for the coil component using a drum core. As one method of realizing a low height of a coil component, a method in which a magnetic top plate generally bonded to a drum core is omitted can be considered. However, in this case, because leakage of the magnetic flux increases, other circuits such as an antenna may be adversely affected. Meanwhile, because a magnetic top plate made of ferrite is fragile, if the thickness thereof is reduced, its strength becomes insufficient, and thus the magnetic top plate may be broken at the time of assembly or at the time of actual use.

To solve the above problems, it suffices to use magnetic-powder containing resin having flexibility instead of using ferrite as a material of the magnetic top plate. The magnetic-powder containing resin can maintain certain strength even if it is thinned. Therefore, by using the magnetic-powder containing resin as the material of the magnetic top plate, leakage of the magnetic flux can be suppressed while realizing a low height. As an example of using magnetic-powder containing resin as a material of a magnetic top plate, coil components described in Japanese Patent Application Laid-open No. H9-219318 and Japanese Patent Application Laid-open No. 2004-363178 can be mentioned.

Magnetic-powder containing resin can be produced by applying a mixed solution in which magnetic powder is mixed in binder resin to a base material such as a base film. However, because general magnetic powder has a spherical shape or a shape similar thereto, a certain degree of thickness is required in order to obtain sufficient magnetic properties. Therefore, it is difficult to largely reduce the thickness of the magnetic top plate made of magnetic-powder containing resin, and it has been difficult to achieve a sufficiently low height.

SUMMARY

Therefore, it is an object of the present invention to realize a further lower height of a coil component by providing a thinner magnetic top plate.

A coil component according to the present invention includes a drum core having a winding core and first and second flange portions provided at opposite ends of the winding core, wires wound around the winding core, terminal electrodes respectively provided in the first and second flange portions and connected with ends of the wires, and a magnetic top plate made of magnetic-powder containing resin in which soft magnetic metal powder having a flat shape is mixed in binder resin, being fixed to the first and second flange portions.

According to the present invention, because soft magnetic metal powder having a flat shape is used as magnetic powder, even if the thickness of the magnetic top plate is made thinner than a conventional magnetic top plate, high magnetic properties and shield effect can be ensured. Accordingly, a further lower height of a coil component can be realized.

According to the present invention, in the magnetic top plate, it is preferable that a ratio of a region in which the soft magnetic metal powder is present as viewed in a thickness direction to the entire area as viewed in the thickness direction is equal to or higher than 80%. Accordingly, even if the thickness of the magnetic top plate is made thin, leakage of the magnetic flux can be suppressed sufficiently.

In this case, it is more preferable that the magnetic top plate includes an outer peripheral region accounting for 10% of the entire area and a central region surrounded by the outer peripheral region, and a ratio of the central region in which the soft magnetic metal powder is present as viewed in the thickness direction to the entire area of the central region is equal to or higher than 95%. In the outer peripheral region of the magnetic top plate, the soft magnetic metal powder falls off mainly at the time of machining, and thus the proportion of the soft magnetic metal powder tends to decrease. However, even in this case, if 95% or more of the central region is covered with the soft magnetic metal powder, leakage of the magnetic flux can be suppressed sufficiently.

According to the present invention, high magnetic properties can be ensured even if the magnetic top plate is made thinner than a conventional magnetic top plate, thereby enabling to realize a further lower height of the coil component.

BRIEF DESCRIPTION OF THE DRAWINGS

The above features and advantages of the present invention will be more apparent from the following description of certain preferred embodiments taken in conjunction with the accompanying drawings, in which.

DETAILED DESCRIPTION OF THE EMBODIMENTS

Preferred embodiments of the present invention will be explained below in detail with reference to the accompanying drawings.

Figure 1:
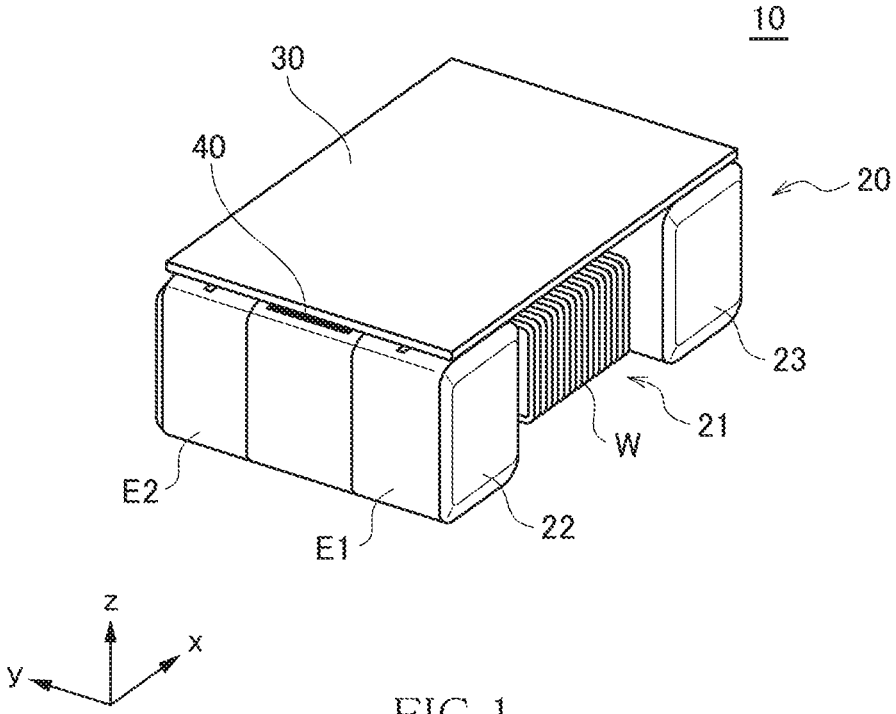
FIG. 1 is a perspective view of a coil component according to a preferred embodiment of the present invention when an upper surface thereof is viewed from an oblique direction.
Figure 2:
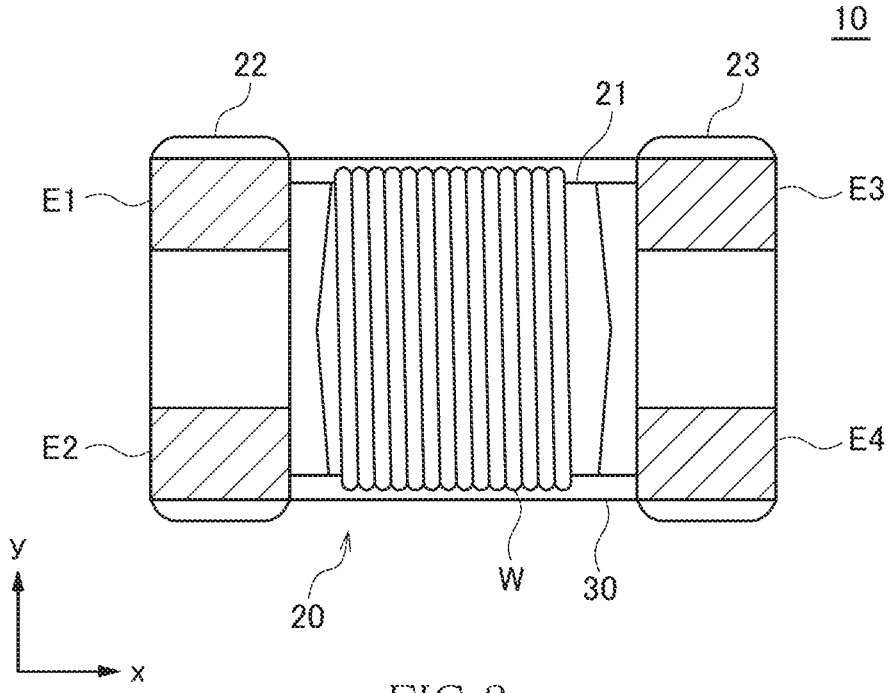
FIG. 2 is a plan view of the coil component according to the preferred embodiment of the present invention as viewed from a mounting surface.

FIG. 1 and FIG. 2 are diagrams showing an appearance of a coil component 10 according to a preferred embodiment of the present invention. FIG. 1 is a perspective view of the coil component when an upper surface thereof is viewed from an oblique direction, and FIG. 2 is a plan view thereof as viewed from a mounting surface.

As shown in FIG. 1 and FIG. 2, the coil component 10 according to the present embodiment includes a drum core 20 and a magnetic top plate 30. The drum core 20 has a winding core 21 with an x direction being an axial direction, and first and second flange portions 22 and 23 provided at opposite ends of the winding core 21 in the x direction. The drum core 20 is made of a ceramic material having high magnetic permeability such as ferrite, and has a configuration in which the winding core 21 and the flange portions 22 and 23 are integrally formed.

Two wires W are wound around the winding core 21, and opposite ends of these wires W are respectively connected to terminal electrodes E1 to E4 provided in the flange portions 22 and 23. In the present embodiment, the terminal electrodes E1 and E2 are formed in one flange portion 22, and the terminal electrodes E3 and E4 are formed in the other flange portion 23. The terminal electrodes E1 to E4 are formed continuously on an xy plane of the flange portions 22 and 23 constituting a mounting surface, an xy plane of the flange portions 22 and 23 located opposite to the mounting surface and constituting an upper surface, and yz planes of the flange portions 22 and constituting outer side surfaces. In the present embodiment, the wires W are respectively connected to the terminal electrodes E1 to E4 provided on the upper surfaces of the flange portions 22 and 23; however, the wires W can be connected to the terminal electrodes E1 to E4 provided on the mounting surfaces of the flange portions 22 and 23. In this case, the terminal electrodes E1 to E4 do not need to be provided on the upper surfaces of the flange portions 22 and 23.

The application of the coil component 10 according to the present embodiment is not particularly limited to any type, and can be a general-purpose coil component for inductance, or can be a coil component for a specific application, for example, for a common-mode filter, for a pulse transformer, or for a balun transformer. Therefore, the number of wires W wound around the winding core 21, the number of windings, the winding direction, and the winding method are not particularly limited to any specific number. The size of the coil component 10 is not particularly limited to any specific size. However, the length in the x direction is about 1.6 millimeters, the width in a y direction is about 1.0 millimeter, and the height in a z direction is from about 0.55 millimeter to about 0.65 millimeter.

As shown in FIG. 1, the magnetic top plate 30 is fixed on the xy plane constituting the upper surfaces of the flange portions 22 and 23 via an adhesive 40. The magnetic top plate 30 is made of magnetic-powder containing resin obtained by mixing soft magnetic metal powder having a flat shape in binder resin, and has higher magnetic permeability than general resin. Because the magnetic top plate 30 is fixed on the upper surfaces of the flange portions 22 and 23 so as to span the wiring core 21, the drum core 20 and the magnetic top plate 30 constitute a closed magnetic path. Therefore, as compared to a case where a top plate made of only resin is used, leakage of the magnetic flux decreases, and magnetic impact on other circuits, for example, on an antenna circuit can be reduced. Further, the magnetic top plate 30 is also used as an adsorption face for handling at the time of mounting on a printed circuit board.

As described above, the magnetic-powder containing resin constituting the magnetic top plate 30 is obtained by mixing soft magnetic metal powder having a flat shape in the binder resin. The binder resin preferably has a cross-linked structure by urethane bond, with acrylic ester copolymer being a main chain. Meanwhile, the soft magnetic metal powder has a flat shape and is mixed in the binder resin so that a principal plane thereof forms the xy plane. In other words, the soft magnetic metal powder having a flat shape is mixed in the binder resin so that the thickness direction of the soft magnetic metal powder is the z direction. Accordingly, even if the thickness of the magnetic top plate 30 is reduced, magnetic permeability in the x direction, which is the direction of the magnetic flux passing the magnetic top plate 30, is increased, and the soft magnetic metal powder having a flat shape also functions as an electromagnetic shield.

Figure 3:
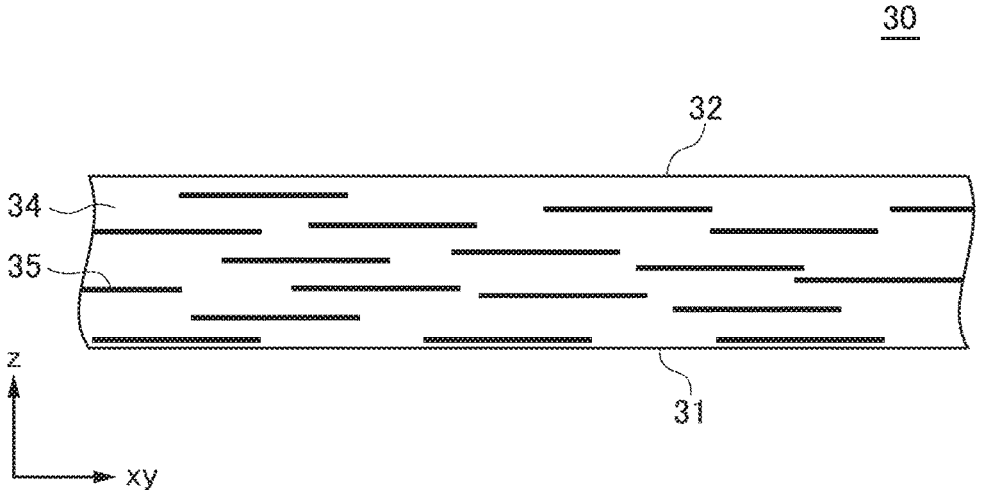
FIG. 3 is an explanatory schematic sectional view of the structure of a magnetic top plate.

FIG. 3 is an explanatory schematic sectional view of the structure of the magnetic top plate 30.

As shown in FIG. 3, the magnetic top plate 30 has a lower surface 31 bonded to the flange portions 22 and 23 and an upper surface 32 located opposite to the lower surface 31. In an inner layer part of the magnetic top plate 30, soft magnetic metal powder 35 having a flat shape is distributed in the binder resin 34 substantially uniformly. Because the soft magnetic metal powder 35 has a flat shape in which the thickness direction thereof is the z direction, some of the soft magnetic metal powder 35 overlaps on each other in the z direction. Therefore, even if the thickness of the magnetic top plate 30 is reduced, substantially the entire area of the magnetic top plate as viewed from the z direction is covered with the soft magnetic metal powder 35.

Figure 4:
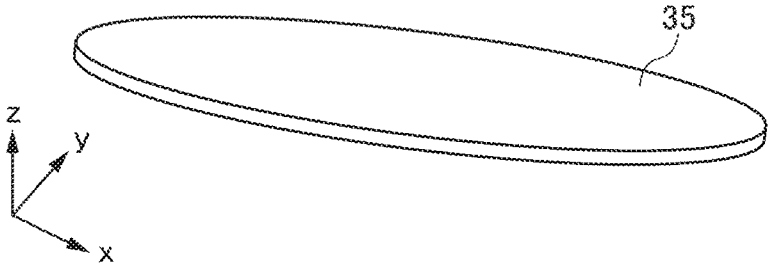
FIG. 4 is an explanatory schematic diagram of the shape of a soft magnetic metal powder contained in the magnetic top plate.

FIG. 4 is an explanatory schematic diagram of the shape of the soft magnetic metal powder 35 contained in the magnetic top plate 30.

As shown in FIG. 4, the soft magnetic metal powder 35 has a shape being flat in the xy direction. The soft magnetic metal powder 35 shown in FIG. 4 has a shape in which the x direction thereof is a longitudinal direction; however, the shape of the soft magnetic metal powder 35 is not limited thereto. In this manner, if soft magnetic metal powder 35 being flat in the xy direction is used, high magnetic permeability can be obtained in the x direction, which is the direction of the magnetic flux passing the magnetic top plate 30.

Figure 5:
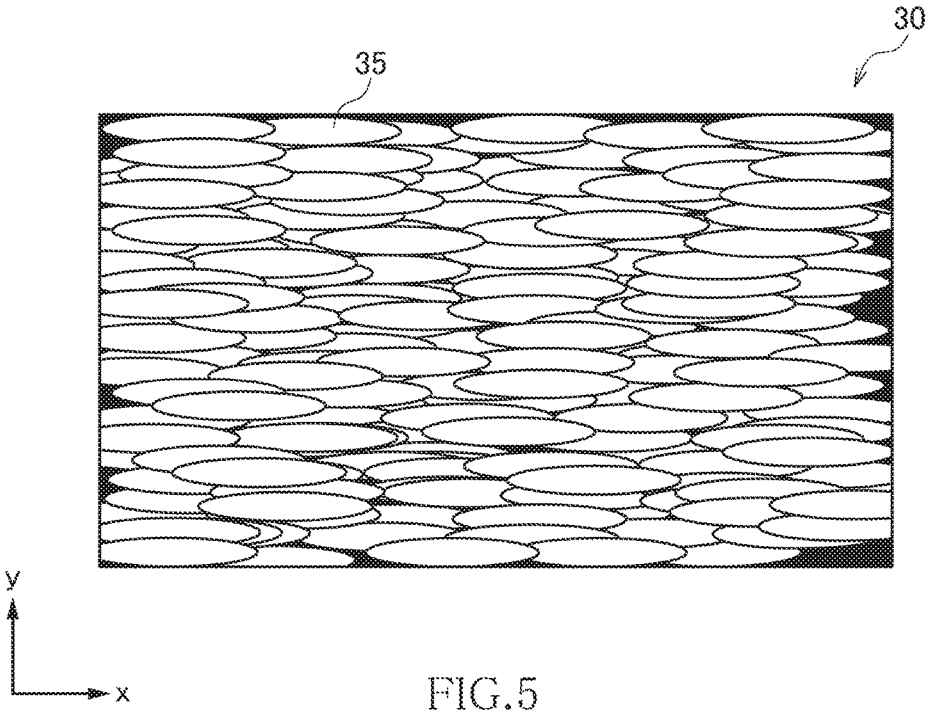
FIG. 5 is transparent view of the magnetic top plate as viewed in the z direction.

FIG. 5 is transparent view of the magnetic top plate 30 as viewed in the z direction, in which a portion where there is no soft magnetic metal powder 35 is blacked out.

As shown in FIG. 5, when the magnetic top plate 30 is transparently viewed in the z direction, it is understood that substantially the entire area thereof is covered with the soft magnetic metal powder 35. However, because the positions of the soft magnetic metal powder 35 in the binder resin are random, there is a slight possibility that there is a region where there is no soft magnetic metal powder 35 as viewed in the z direction (black regions shown in FIG. 5), depending on the thickness of the magnetic top plate 30 and the density of the soft magnetic metal powder 35. Even in this case, if a ratio of the region where the soft magnetic metal powder 35 is present as viewed in the z direction to the entire area is equal to or higher than 80%, sufficient magnetic properties and shield effect can be ensured.

Figure 6:
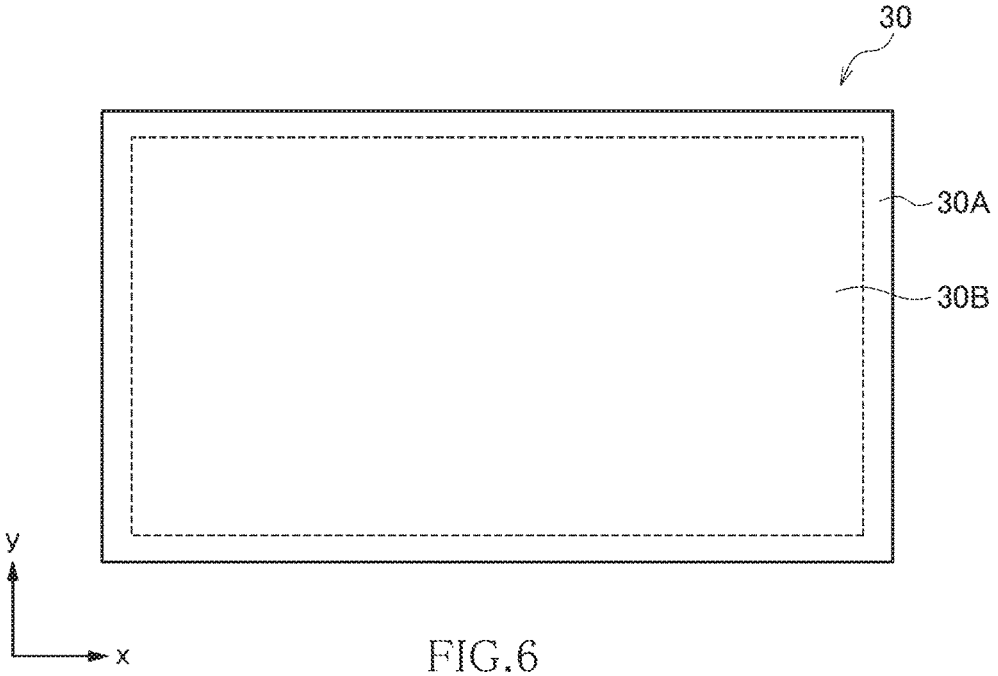
FIG. 6 is a schematic plan view for explaining an outer peripheral region and a central region of the magnetic top plate.

The density of the soft magnetic metal powder 35 in the magnetic top plate 30 may change depending on the plan position. For example, as shown in FIG. 6, if it is defined that a region that is within a predetermined distance range from an outer peripheral edge of the magnetic top plate 30 and accounts for 10% of the entire area is an outer peripheral region 30A, and a region surrounded by the outer peripheral region 30A is a central region 30B, the density of the soft magnetic metal powder 35 in the outer peripheral region 30A may become lower than that in the central region 30B. This is because some of the soft magnetic metal powder 35 falls off from the outer peripheral region 30A of the magnetic top plate 30 mainly at the time of machining. Due to such uneven distribution of the soft magnetic metal powder 35, the ratio of the region where the soft magnetic metal powder 35 is present as viewed in the z direction may decrease. However, even in this case, if 95% or more of the central region 30B is covered with soft magnetic metal powder, sufficient magnetic properties and shield effect can be ensured.

While it is not particularly limited thereto, the thickness of the magnetic top plate 30 in the z direction is preferably equal to or less than 100 micrometers, more preferably equal to or less than 75 micrometers, and particularly preferably about 60 micrometers. If the thickness of the magnetic top plate 30 is equal to or less than 100 micrometers, the height of the entire coil component 10 in the z direction can be set low. When the thickness of the magnetic top plate is reduced to 100 micrometers or less while using ferrite, the magnetic top plate may be broken due to insufficient strength. However, if the magnetic top plate 30 in which the soft magnetic metal powder 35 is mixed in the binder resin 34 is used, even if the thickness is reduced to 100 micrometers or less, there will be no breakage. Further, even if the thickness is reduced to 100 micrometers or less, high magnetic properties can be ensured as compared to a case where magnetic powder having a spherical shape or a shape similar thereto is used. While the lower limit of the thickness of the magnetic top plate 30 is not particularly limited to any size, it is preferable that the lower limit is equal to or higher than 30 micrometers. This is because if the thickness of the magnetic top plate 30 is reduced to less than 30 micrometers, the strength is not sufficient, and it is difficult to ensure sufficient magnetic properties. To suppress leakage of the magnetic flux sufficiently, it is preferable that the magnetic permeability of the magnetic top plate 30 is equal to or higher than 30.

Predetermined flexibility, heat resistance, and strength are required for the binder resin to be used for the magnetic top plate 30. The reason the flexibility and the strength are required is that even if the thickness of the magnetic top plate 30 is reduced, for example, to 100 micrometers or less, there will be no breakage. The reason the heat resistance is required is that there will be no deformation at the time of reflow. Therefore, a material having high strength but low flexibility, and a material having high flexibility but low heat resistance are not appropriate. Because the reflow temperature is about 260° C., at least binder resin that is not deformed at that temperature needs to be used.

Taking these points into consideration, in the present embodiment, binder resin having a cross-linked structure by urethane bond, with acrylic ester copolymer being a main chain is used. Regarding the composition, although not particularly limited thereto, the acrylic ester copolymer preferably has at least a copolymer structure of ethyl acrylate and a copolymer structure of butyl acrylate. This is for adding the flexibility by the copolymer structure of butyl acrylate, while ensuring high strength by the copolymer structure of ethyl acrylate. It is also preferable that the acrylic ester copolymer further has a copolymer structure of acrylonitrile. This is because the heat resistance and strength are increased by containing the copolymer structure of acrylonitrile.

The magnetic top plate 30 can be manufactured according to the following method. First, a binder solution in which a solute containing ethyl acrylate, butyl acrylate, and acrylonitrile having a hydroxyl group or a carboxyl group as a functional group is a main monomer is dissolved in an organic solvent such as methyl ethyl ketone is prepared. A mixed solution is prepared by mixing soft magnetic metal powder and a curing agent in the binder solution. As the curing agent, it is preferable to use isocyanate. As the isocyanate, for example, it is preferable to use, for example, aromatic isocyanate or isocyanate containing a triazine ring in the structure, and more preferably, containing a plurality of isocyanate groups in one molecule. Accordingly, the hydroxyl group or the carboxyl group contained as the functional group in the acrylic ester copolymer reacts with isocyanate to form the cross-linked structure. Further, a filler other than the soft magnetic metal powder, for example, talc or mica can be further mixed therein.

Figure 7:
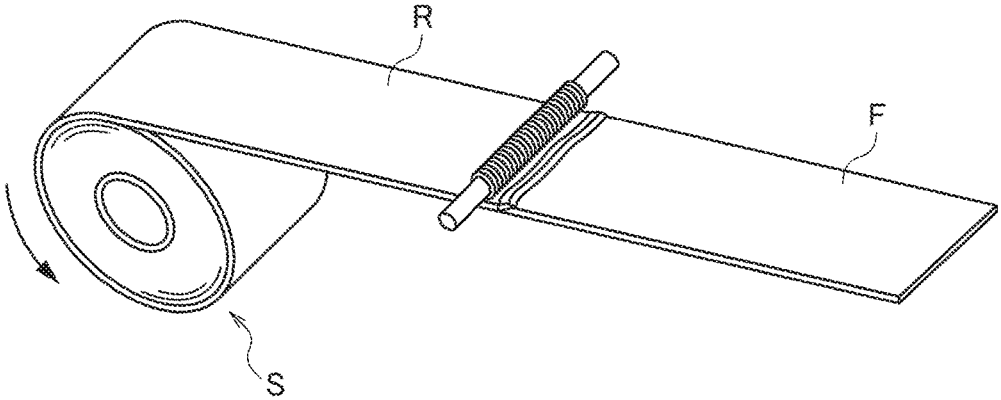
FIG. 7 is an explanatory schematic diagram for explaining a manufacturing method of a sheet in which a magnetic-powder containing resin is coated on a base film.

As shown in FIG. 7, the mixed solution is applied onto a base film F, the base film F is then wound around a roll while heating the base film F to dry the solvent in the mixed solution and cure the binder resin. The soft magnetic metal powder can be oriented in a predetermined direction by applying magnetic field at the time of applying the mixed solution onto the base film F. Accordingly, a sheet S in which magnetic-powder containing resin R is applied onto the surface of the base film F is obtained. As the base film F, a PET film can be used. It is preferable that a content ratio of the soft magnetic metal powder in the cured magnetic-powder containing resin is from 50% to 90% by weight. If the content ratio of the soft magnetic metal powder is less than 50% by weight, sufficient magnetic permeability cannot be obtained, and if the content ratio thereof exceeds 90% by weight, the possibility that the soft magnetic metal powder falls off from a cut surface of the magnetic top plate 30 increases. By using such an application method, the principal plane of the flat soft magnetic metal powder naturally becomes parallel to the principal plane of the base film F.

Figure 8A:
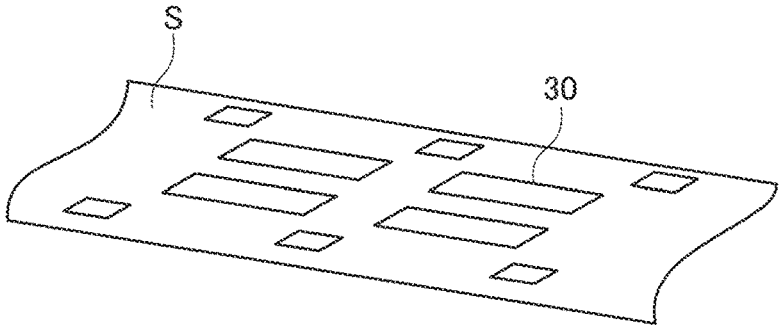
FIGS. 8A to 8C are process diagrams for explaining a manufacturing method of the coil component.
Figure 8B:
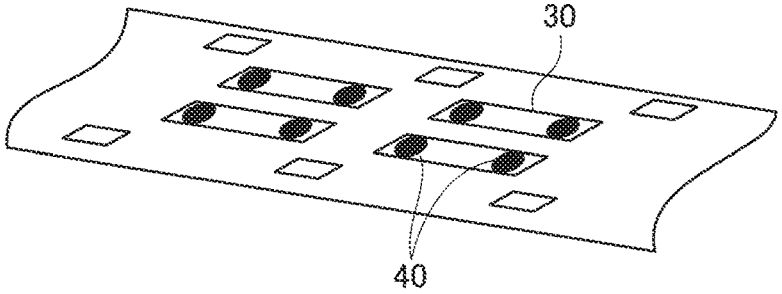
Figure 8C:
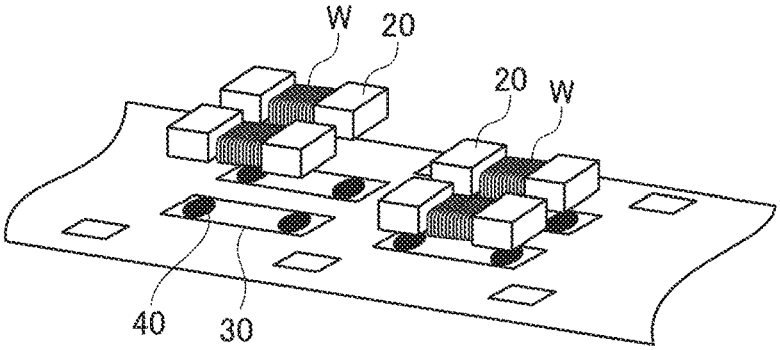

Subsequently, as shown in FIG. 8A, the sheet S is punched in a planar shape of the magnetic top plate 30 by a mold. Next, as shown in FIG. 8B, an epoxy adhesive 40 is applied to a punched portion, and as shown in FIG. 8C, a drum core 20 wound with the wire W is bonded thereto. The drum core 20 bonded with the magnetic top plate 30 is separated from the sheet body, and the base film F is peeled off, thereby completing the coil component 10 according to the present embodiment.

As described above, the coil component 10 according to the present embodiment uses the magnetic-powder containing resin obtained by mixing the soft magnetic metal powder 35 having a flat shape in the binder resin as the material of the magnetic top plate 30. Accordingly, even if the thickness of the magnetic top plate 30 is reduced, high magnetic properties and shield effect can be ensured.

It is apparent that the present invention is not limited to the above embodiments, but may be modified and changed without departing from the scope and spirit of the invention.

What is claimed is:

1. A coil component comprising:

a drum core having a winding core and first and second flange portions provided at opposite ends of the winding core;

a wire wound around the winding core;

terminal electrodes provided in the first and second flange portions, the terminal electrodes being connected to ends of the wire; and a magnetic top plate made of magnetic-powder containing resin in which soft magnetic metal powder having a flat shape is mixed in binder resin, the magnetic top plate being fixed to the first and second flange portions and including an outer peripheral region accounting for 10% of the entire area and a central region surrounded by the outer peripheral region;

wherein a ratio of the central region in which the soft magnetic metal powder is present as viewed in a thickness direction to an entire area of the central region is equal to or higher than 95%.

2. A coil component comprising:

a drum core having a winding core and first and second flange portions provided at opposite ends of the winding core;

a wire wound around the winding core;

terminal electrodes provided in the first and second flange portions, the terminal electrodes being connected to ends of the wire; and a magnetic top plate made of magnetic-powder containing resin in which soft magnetic metal powder having a flat shape is mixed in binder resin, the magnetic top plate being fixed to the first and second flange portions, wherein the magnetic top plate includes an outer peripheral region accounting for 10% of an entire area and a central region surrounded by the outer peripheral region, and wherein a ratio of the central region in which the soft magnetic metal powder is present as viewed in a thickness direction to an entire area of the central region is equal to or higher than 95%.

* * * * *